US005460559A

United States Patent [19]

Van Der Wilk et al.

[11] Patent Number: 5,460,559

[45] Date of Patent: Oct. 24, 1995

[54] CATHODE RAY TUBE

[75] Inventors: Ronald Van Der Wilk; Gerardus A. H. M. Vrijssen, both of Eindhoven, Netherlands

[73] Assignee: U.S. Philips Corporation, New York, N.Y.

[21] Appl. No.: 273,673

[22] Filed: Jul. 12, 1994

[30] Foreign Application Priority Data

Jul. 20, 1993 [BE] Belgium ..... 09300759

[51] Int. Cl.[6] ..... H01J 9/02

[52] U.S. Cl. ..... 445/46; 445/59

[58] Field of Search ..... 445/35, 59, 46

[56] References Cited

U.S. PATENT DOCUMENTS

| | | | |
|---|---|---|---|
| 3,556,627 | 1/1971 | Takemoto | 445/59 |
| 4,111,507 | 9/1978 | Neuber et al. | 445/72 |
| 4,398,896 | 8/1983 | Van Alphen | 445/5 |
| 4,406,639 | 9/1983 | Williams | 445/59 |

*Primary Examiner*—Kenneth J. Ramsey
*Attorney, Agent, or Firm*—Robert J. Kraus

[57] ABSTRACT

Electrodes of an electron gun are etched in an electrochemical bath. The electrodes to be etched serve as the anode in the bath. The side of the electrode to be etched which faces the cathode in the chemical bath, faces an electrode at a higher potential in the assembled electron gun.

2 Claims, 2 Drawing Sheets

CATHODE RAY TUBE

BACKGROUND OF THE INVENTION

The invention relates to a method of manufacturing a cathode ray tube comprising an electron gun having electrodes.

Cathode ray tubes are used, inter alia, in television receivers, computer monitors and oscilloscopes.

Cathode ray tubes of the type mentioned in the opening paragraph comprise an electron gun having electrodes. In the electron gun one or more electron beams are generated. In operation, electro-optical fields are generated by means of electrodes having apertures for allowing passage of the electron beam(s). The electron beams are accelerated and focused by means of said fields. High voltages (above approximately 10 kV) voltages are applied to some electrodes. In particular in cathode ray tubes having a high picture quality, for example so-called HDTV display tubes or display tubes for High-Res (high resolution) computer monitors there is a tendency to apply ever increasing voltages to the electrodes. Such high voltages cause a number of problems, hereinafter referred to as "high-voltage behaviour". Electron sparks may hop between electrodes, the so-called "flashover". Such sparks may damage the display tube, cause loose parts in the display tube and/or adversely affect the life of the display tube. Under certain conditions this phenomenon also leads to a disturbing ticking or crackling noise. It is also possible that electrons are emitted from an electrode, the so-called "blue glow". These electrons adversely affect the contrast of the image displayed on the display screen. This also causes leakage currents between the electrodes. In operation, these leakage currents cause fluctuations of the electronic voltage between the electrodes and hence fluctuations of the image displayed.

SUMMARY OF THE INVENTION

It is an object of the invention to provide a method in which one or more of the above problems are reduced.

To this end, the method in accordance with the invention is characterized in that at least one electrode of the electron gun is etched in an electrochemical bath, in such a manner that in the electrochemical etching process a voltage difference is applied between the electrode to be etched and a counterelectrode so that the electrode is at a positive voltage with respect to the counterelectrode and, preferably, the side of the electrode which, in the assembled electron gun faces an electrode which is at a higher voltage during operation, faces the counterelectrode in the electrochemical bath.

In the electrochemical bath, the electrode to be etched constitutes an anode (positive voltage) and the counterelectrode constitutes a cathode (negative voltage). In the electrochemical bath an electric field is formed between said electrodes and the side of the electrode to be etched facing the counterelectrode is etched. As a result, a surface is formed on this side which exhibits no or substantially no high-voltage problems during operation. In the assembled electron gun this surface faces an electrode which is at a higher voltage.

A preferred embodiment is characterized in that the electron gun comprises an assembly of electrodes which, in operation, form an electron-optical main lens with an electrode at a higher voltage (anode) and an electrode at a lower voltage (focusing electrode), and in that said focusing electrode, preferably the side of the focusing electrode facing the anode, is etched in the electrochemical bath.

In operation, the strongest electric fields and the greatest high-voltage problems occur between the anode and the focusing electrode.

BRIEF DESCRIPTION OF THE DRAWINGS

These and other aspects of the invention will be explained in greater detail by way of example and with reference to the accompanying drawing figures, in which.

The Figures are not drawn to scale. In general, like reference numerals refer to like parts.

DESCRIPTION OF THE PREFERRED EMBODIMENT

Figure 1:
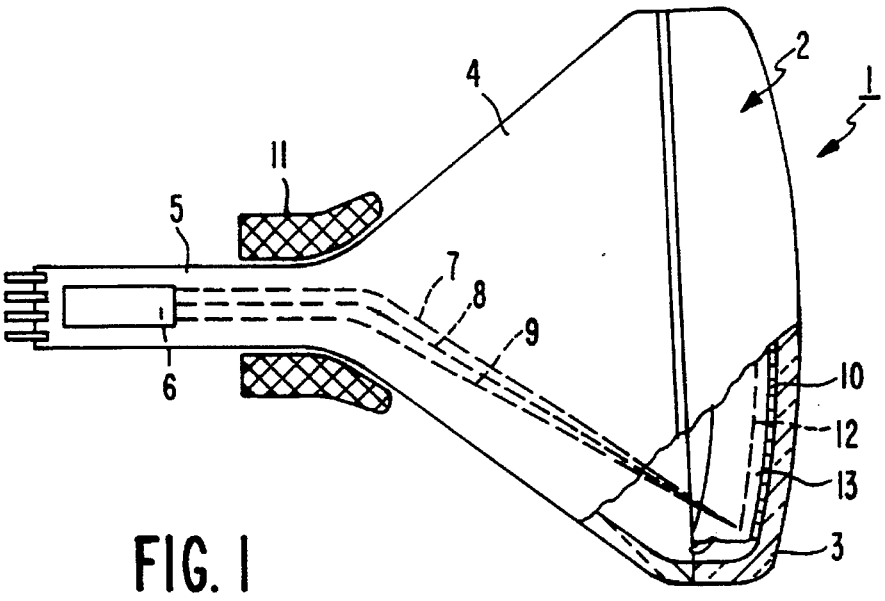
FIG. 1 is a cathode ray tube.

A colour display tube 1 (FIG. 1) comprises an evacuated envelope 2 having a display window 3, a cone portion 4 and a neck 5. In the neck 5 there is provided an electron gun 6 for generating three electron beams 7, 8 and 9. A display screen 10 is present on the inside of the display window. Said display screen 10 comprises a phosphor pattern of phosphor elements luminescing in red, green and blue. On their way to the display screen 10 the electron beams 7, 8 and 9 are deflected across the display screen 10 by means of a deflection unit 11 and pass through a shadow mask 12 which is arranged in front of the display window 3 and which comprises a thin plate having apertures 13. The shadow mask is suspended in the display window by means of suspension means 14. The three electron beams 7, 8 and 9 pass through the apertures 13 of the shadow mask at a small angle with respect to each other and, consequently, each electron beam impinges on phosphor elements of only one colour.

Figure 2:
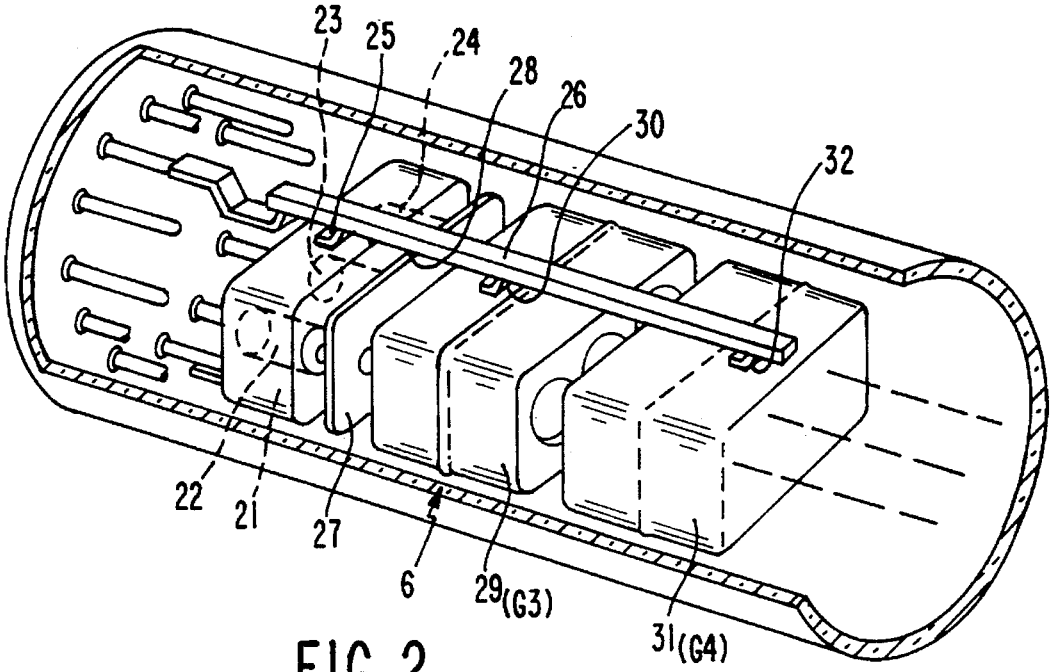
FIG. 2 is an electron gun.

FIG. 2 is a partly perspective view of an electron gun 6. Said electron gun comprises a common control electrode 21, also referred to as $G_1$ electrode, in which three cathodes 22, 23 and 24 are secured. The $G_1$ electrode is secured to supports 26 by means of connecting elements 25. Said supports are made of glass. An example of such supports are the supports which are commonly referred to as "beading rods". In this example, the electron gun 6 further comprises a common plate-shaped electrode 27, also referred to as $G_2$ electrode, which is secured to the supports by connecting elements 28. In this example, the electron gun 6 comprises two supports 26. One of said supports is shown, the other is situated on the side of the electron gun 6 which is invisible in this perspective view. The electron gun 6 further comprises the common electrodes 29 up to and including 32 which are also secured to supports 26 by means of connecting elements.

Figure 3:
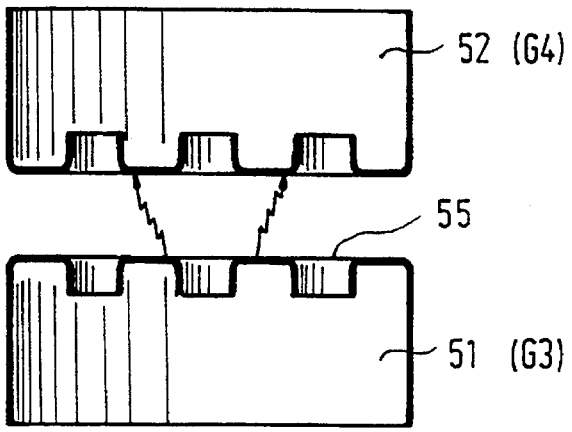
FIG. 3 is an illustration of high-voltage problems.

FIG. 3 is a diagrammatic illustration of high-voltage problems. In operation, a voltage difference is applied between two electrodes 51 and 52. In this example, the $G_3$ (51) and $G_4$ (52) electrodes are shown. As a result, sparks 53 may hop between the electrodes. These sparks may cause material of one of the electrodes to become detached. This results in loose pans. Even if spark hopping does not take place, electrons may be emitted by an electrode as a result of the so-called "cold emission". This causes a "blue glow" in the tube. Both the sparks and "cold emission" of electrons generally originate in irregularities or burrs on the surface of the electrodes, more particularly on the surface 55 of electrode 51 ($G_3$).

Figure 4:
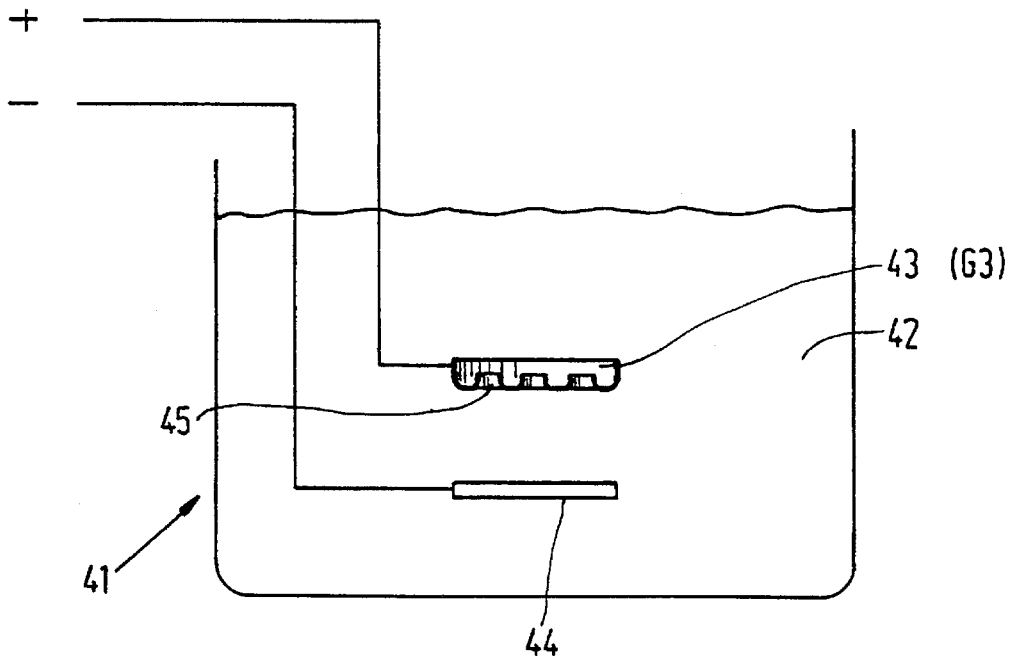
FIG. 4 is a diagrammatic representation of an electrochemical bath.

FIG. 4 diagrammatically shows an arrangement for the electrochemical etching of electrodes.

A container 41 contains an etching liquid 42. In said etching liquid there is provided an electrode 43, in this example the $G_3$ electrode. A potential difference is applied between this electrode and cathode 44, so that the $G_3$ electrode serves as the anode (positive electrode). The $G_4$ electrode can be used as the cathode, however, this is not essential. An example of a suitable etching liquid is a solution of 7 parts by weight of $H_3PO_4$ and 1 part by weight of $H_2SO_4$ in 2 parts by weight of water. As a result of electrochemical etching, small irregularities and burrs are removed from the surface of the electrode $G_3$. Preferably, the $G_3$ electrode is arranged so that the side 45 of the $G_3$ electrode which faces the $G_4$ electrode in the electron gun, faces the cathode in the electrochemical bath.

The following Table diagrammatically shows the effect of electrochemically etching the $G_3$ electrode in the manner described above.

| Test | Voltage difference triggering a first sparkover (in kV) |
|---|---|
| A (test) | 20 ± 5 |
| B (invention) | 31 ± 6 |

In this Table, A represents a test involving 19 tubes whose $G_3$ electrodes are not etched, and B represents a test involving 17 tubes whose $G_3$ electrodes are etched in accordance with the invention in an electrochemical bath. The indicated voltage difference represents the voltage between the $G_3$ and $G_4$ electrodes which triggers a sparkover between said electrodes. In this connection, it is noted that after the occurrence of a first sparkover, in general, a much higher (approximately 10 kV higher) voltage difference is required to trigger a second sparkover.

The Table clearly shows that the high voltage behaviour has improved. Further, the leakage currents between the $G_3$ and $G_4$ electrodes for electron guns comprising an electrochemically etched $G_3$ electrode are at least a factor of ten smaller than in the test (guns which were not treated).

The invention can be summarized as follows.

Electrodes of an electron gun are etched in an electrochemical bath. The electrodes to be etched serve as the anode in the bath. The side of the electrode to be etched which faces the cathode in the electrochemical bath, faces an electrode at a higher potential in the assembled electron gun.

It will be obvious that within the scope of the invention many variations are possible to those skilled in the art. In the example, the $G_3$ electrode is etched electrochemically. However, the invention is not limited thereto, other electrodes can also be etched electrochemically. However, it is noted that the advantage of the invention is important, in particular, if the focusing electrode, i.e. the first electrode of the main lens, viewed from the cathode, is etched. In this example, this electrode is the $G_3$ electrode. Dependent upon the number of electrodes in an electron gun, the focusing electrode can also be referred to as $G_5$ or $G_7$ electrode.

We claim:

1. A method of manufacturing a cathode ray tube comprising an electron gun having electrodes, characterized in that at least one electrode of the electron gun is etched in an electrochemical bath in such a manner that in the electrochemical etching process a voltage difference is applied between the electrode to be etched and a counterelectrode so that the electrode is at a positive voltage with respect to the counterelectrode and the side of the electrode which, in the assembled electron gun, faces an electrode which is at a higher voltage during operation, faces the counterelectrode in the electrochemical bath.

2. A method as claimed in claim 1, characterized in that the electron gun comprises an assembly of electrodes which, in operation, form an electron-optical main lens with an electrode at a higher voltage (anode) and an electrode at a lower voltage (focusing electrode) and in that the side of the focusing electrode facing the anode is etched in the electrochemical bath.

* * * * *